United States Patent [19]

Mendenhall

[11] Patent Number: 4,748,921

[45] Date of Patent: Jun. 7, 1988

[54] METHOD FOR REMOVING FLAMMABLE HAZARDOUS LIQUID WASTE FROM SOILS

[76] Inventor: Robert L. Mendenhall, 1770 Industrial Road, Las Vegas, Nev. 89102

[21] Appl. No.: 80,708

[22] Filed: Aug. 3, 1987

Related U.S. Application Data

[63] Continuation-in-part of Ser. No. 844,947, Mar. 27, 1986, abandoned.

[51] Int. Cl.[4] ..... F23G 5/00; F23D 14/00

[52] U.S. Cl. ..... 110/346; 110/246; 110/236; 432/109; 432/110

[58] Field of Search ..... 432/103–106, 432/109, 110, 114, 117, 118; 110/236, 346

[56] References Cited

U.S. PATENT DOCUMENTS

| | | | |
|---|---|---|---|
| 2,007,121 | 7/1935 | Johansen | 432/109 |
| 2,654,592 | 10/1953 | Harris | 432/109 |
| 3,705,711 | 12/1972 | Seelandt et al. | 110/236 |
| 4,039,171 | 8/1977 | Shearer | 34/136 |
| 4,075,710 | 2/1978 | Jakob et al. | 366/25 |
| 4,240,754 | 12/1980 | Mendenhall | 432/105 |
| 4,427,376 | 1/1984 | Etnyre et al. | 432/110 |
| 4,429,642 | 2/1984 | Deve | 110/236 |
| 4,480,922 | 11/1964 | Mendenhall | 366/25 |
| 4,648,332 | 3/1987 | Goedhart | 110/236 |
| 4,648,333 | 3/1987 | Mudd et al. | 110/236 |
| 4,667,609 | 5/1987 | Hardison et al. | 110/346 |
| 4,700,638 | 10/1987 | Przewolski | 110/236 |

*Primary Examiner*—Henry C. Yuen

*Attorney, Agent, or Firm*—Seiler, Quirk & Tratos

[57] ABSTRACT

A method of removing hazardous flammable hydrocarbons from soils comprises introducing the contaminated soil into a rotatable drum open at only one end, introducing flame and hot gases of combustion in the drum while rotating it to substantially expose the soil to the hot gases thereby heating the soil to a temperature sufficient to substantially vaporize all of the contaminant flammable hydrocarbons therein, and continuing to introduce the flame and hot gases whereby the vaporized hydrocarbon is burned in the drum with the exhaust gases of combustion then directed to atmosphere from the open port. The uncontaminated soil is then recovered from the drum.

4 Claims, 4 Drawing Sheets

METHOD FOR REMOVING FLAMMABLE HAZARDOUS LIQUID WASTE FROM SOILS

REFERENCE TO PRIOR APPLICATIONS

This application is a continuation-in-part of copending application Ser. No. 06/844,947, filed Mar. 27, 1986, now abandoned.

BACKGROUND OF THE INVENTION

Problems of oil, fuel and gasoline spills on the soil or earth around gasoline service stations has been known for some time. However, more recently, attention to such contaminated soil has focused on the problem caused by these petroleum hydrocarbons turning up in municipal water tables, wells, lakes, and other sources. Accidental gasoline and fuel spills are contributory to the problem as is deterioration of fuel holding tanks and associated equipment resulting in leakage of the flammable hydrocarbon materials into the surrounding soil. As these hydrocarbons are leached into water supplies by rain water run-off or other naturally occurring conditions, they become more problematic as the substantial number of gasoline service stations in or near populous areas increases.

Because of the aforesaid problem, environmental protection regulations have recently required that any contaminated soil containing over 200 ppm of these flammable and hazardous hydrocarbon materials be removed and stored in licensed and controlled dumpsites. To remove the soil and replace it with uncontaminated soil is very expensive and time consuming as is the transportation to the storage area.

SUMMARY OF THE INVENTION

The present invention is directed to a method of removing hazardous flammable contaminants, particularly hydrocarbons, from soils. The process includes placing the contaminated soil into a suitable drum heater and heating the soil to volatilize the flammable material and burn it within the drum before venting the exhaust gases of combustion to atmosphere. The process results in a recovered soil substantially free of the hazardous contaminants.

DETAILED DESCRIPTION OF THE INVENTION

Figure 1:
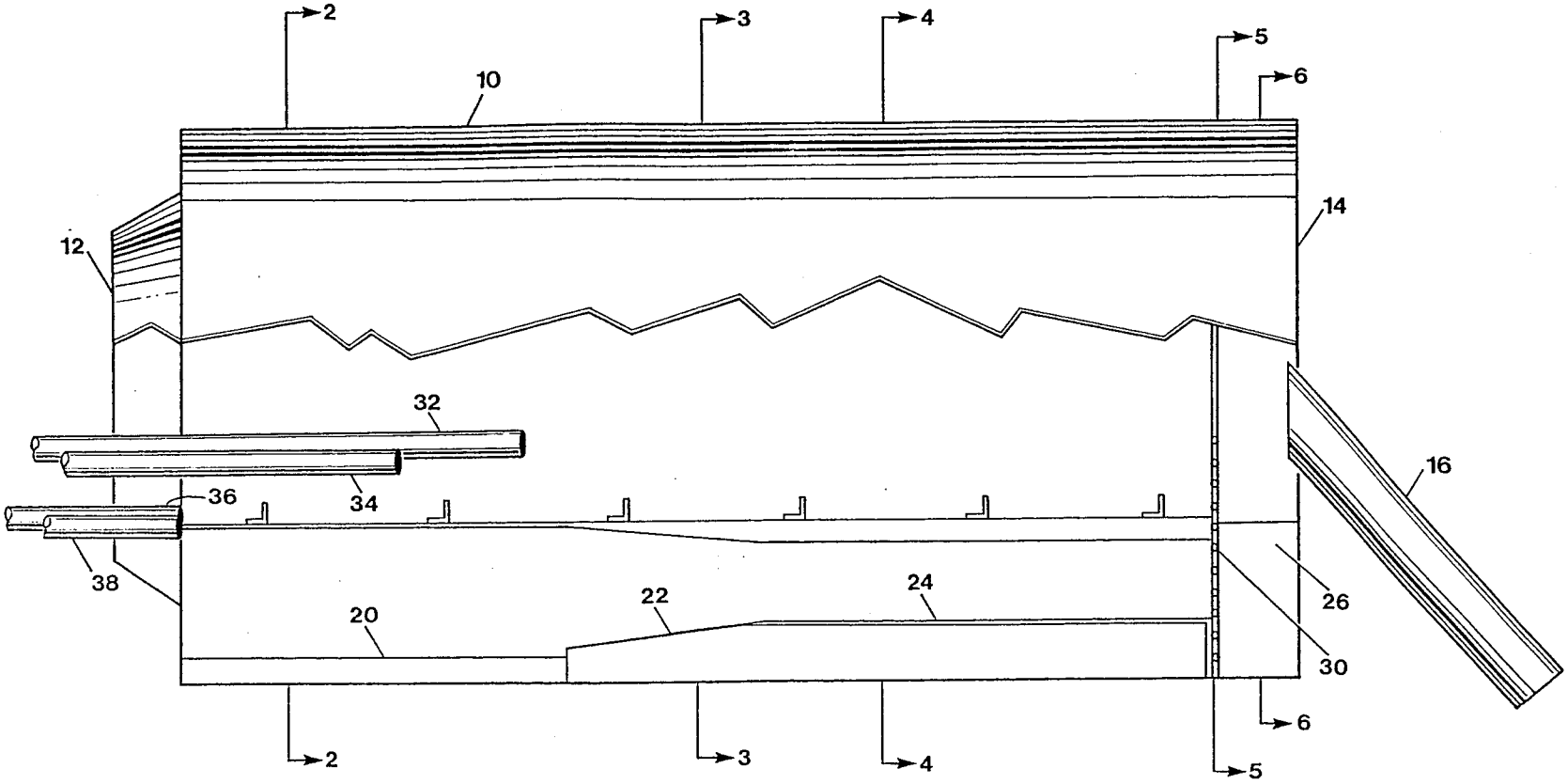
FIG. 1 is a side view of a suitable drum apparatus for carrying out the invention.

In the process of the invention the hazardous contaminated soil is introduced into a drum and heated to volatilize substantially all of the contaminating flammable liquid. By the term soil herein, it is intended to include any earthen material including sand, clay, rocks or any similar mineral or siliceous materials of which ground or other such substrates are comprised. Contaminated soil is generally considered to have over about 100 parts per million of hydrocarbon present. For example, according to the standards of the California Regional Water Quality Control Board, soils which have less than 100 hydrocarbon parts per million are not required to be treated or removed whereas soils having over 100 parts per million are considered contaminated. To treat such material according to this process, the soil is removed from the site and introduced directly into a suitable heating apparatus of the type described hereinafter. Advantageously this may be done at the site whereby the soil may be directly introduced into the heating apparatus, treated to remove the contaminating flammable material, and put back in place, all without it being transported to a remote location. However, under certain circumstances it may be necessary to transport the contaminated soil to the heating apparatus at a different location to carry out the process.

The contaminated soil may be introduced into a heating apparatus by any suitable means such as conveyors, hoppers, chutes, etc. After being introduced into the heating apparatus, preferably a rotating drum into which flame and hot gases of combustion are introduced, the soil is heated to a temperature sufficient to volatilize substantially all of the flammable contaminating material. The specific temperature to which the soil is heated, of course, will depend on the specific flammable materials which are in the soil and are to be volatilized. The most common flammable soil contaminants to be removed according to the process of the invention are petroleum-based hydrocarbons such as kerosene, diesel fuel, fuel oil, gas oil, and lubricating oils including light lube oils and motor oils. These materials have flash points of between about 100° and about 450° F. Of course, it will be necessary to heat the soil to temperatures above the flash point in order to totally volatilize the material from the soil. In the process of the invention, it is desirable to heat the soils to at least about 300° F., and generally temperatures above that point up to about 600° F. and higher. Thus, the invention is not limited to any specific heating temperatures but instead the soil is to be heated to whatever temperature is necessary to volatilize substantially all of the hydrocarbon or other flammable contaminating material therefrom, and then to burn that flammable hydrocarbon in the drum following volatilization. Normally, heating the soil to temperatures of between about 400° and about 600° F. will be suitable. Volatilization of "substantially" all of the hydrocarbon is intended to mean more than 99% of the hydrocarbon is removed from the soil during the process.

As previously noted, a suitable apparatus is one which allows the material to be easily introduced therein, is rotatable so that the soil can be well exposed to the heat and maximizing heat transfer to the soil. A drum apparatus incorporating a burner for introducing flame and hot gases of combustion for heating the soil sufficiently to volatilize the flammable material, and then to burn the flammable material within the interior of the drum is preferred. The drum must also be provided with means for recovering the processed soil as well as for directing the burned gases to atmosphere. Such generally suitable apparatus are disclosed in my U.S. Pat. Nos. 4,208,131, 4,240,754, 4,219,278 and 4,265,546. All of those patents disclose rotatable drums having means for feeding of material therein as well as providing a burner means for introducing flame and hot gases of combustion to heat the materials. Most desirable apparatus is disclosed in my U.S. Pat. Nos. 4,326,809, 4,382,682, 4,480,922, 4,439,040 and 4,398,826. It is intended that the pertinent portions of the aforesaid patents disclosing such a suitable apparatus are incorporated herein by reference. The drums disclosed in latter patents are especially suitable because of the flight or lifter patterns within the drum that enhance heating efficiency and soil handling according to the preferred process of the invention.

Figure 2:
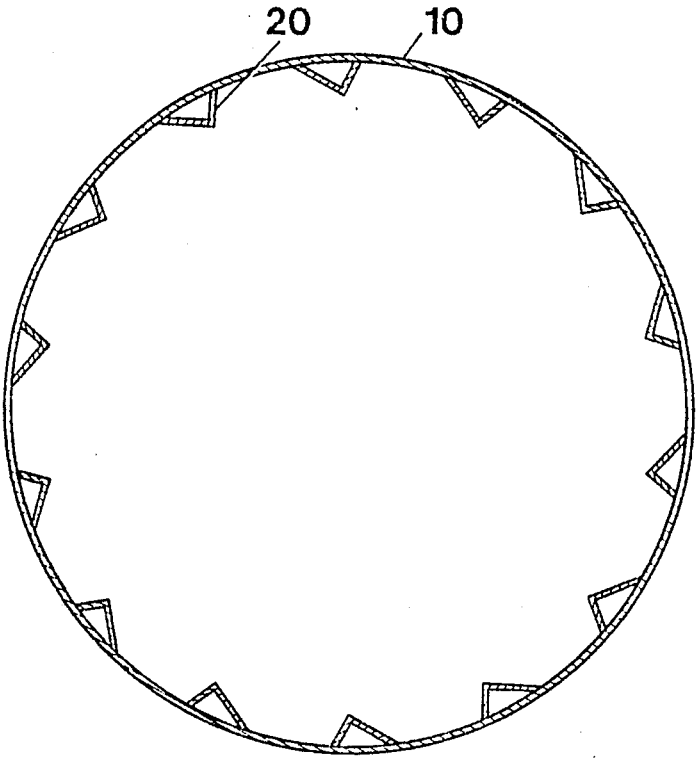
FIGS. 2–6 are sectional views of the drum taken along lines 2—2, 3—3, 4—4, 5—5, and 6—6, respectively, of FIG. 1.

Of particular importance is a preferred manner the soil is handled and processed in the method of the invention. In a preferred apparatus as illustrated in FIG. 1, or as shown in the aforesaid patents, composition is introduced into a first end 12 of the drum and recovered from the opposite output end 14. The drum is inclined from horizontal and during rotation the composition is gradually moved gravitationally from the input end to the output or product recovery end. In the preferred apparatus the lifters in the drum cause the soil to be exposed differently in three different sections of the drum. Observing further FIG. 1, in the first section of the drum nearest the input end 12, the lifters do not create a veil or curtain of soil particles but simply cause the material to be banked along the side in the direction of drum rotation and cascade toward the bottom thereby providing surface exposure of the soil to the hot gases. A cross-section of the drum in this first section is shown in FIG. 2. Lifters 20 are conveniently made from angle iron, or the like. Burner tubes 32, 34, 36, and 38 terminate in the first section without significant exposure to falling soil particles.

Figure 3:
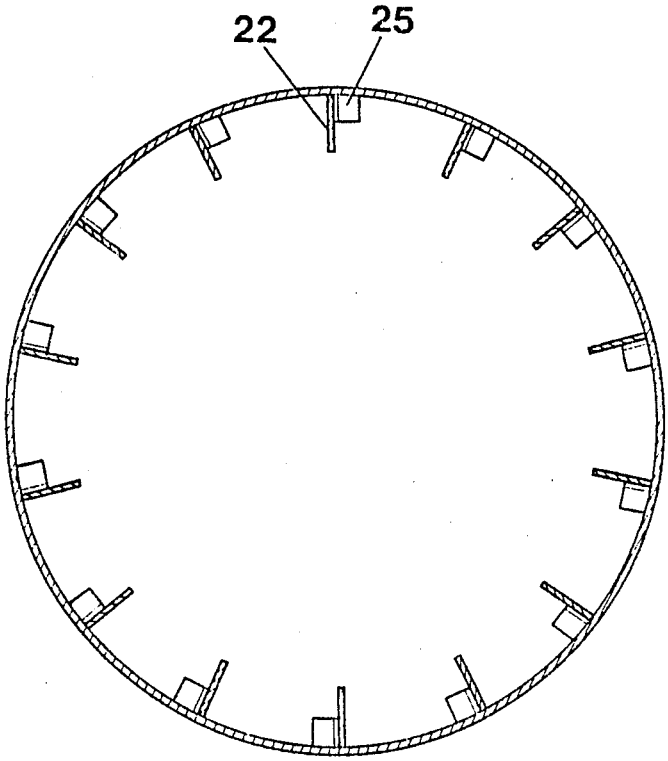
Figure 4:
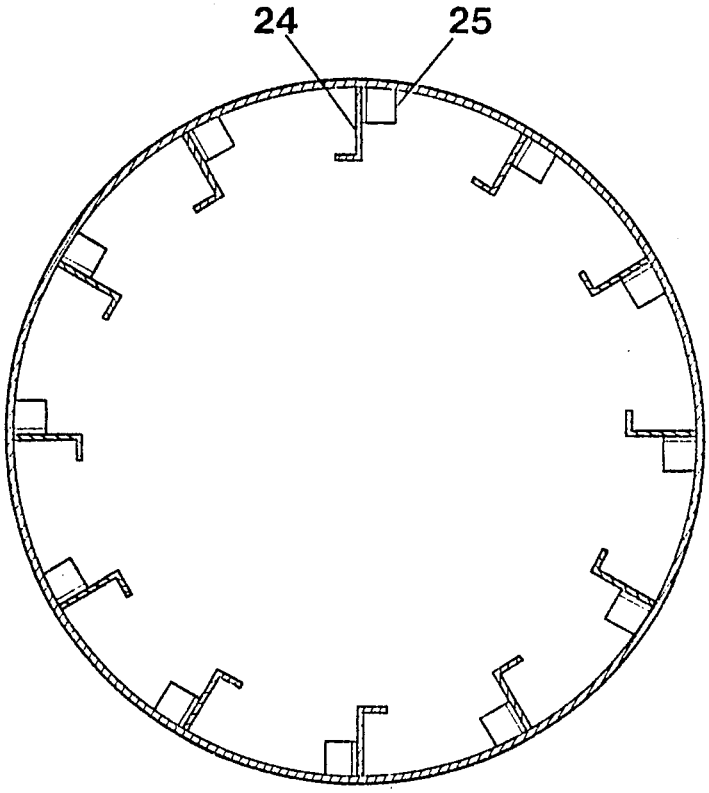
Figure 5:
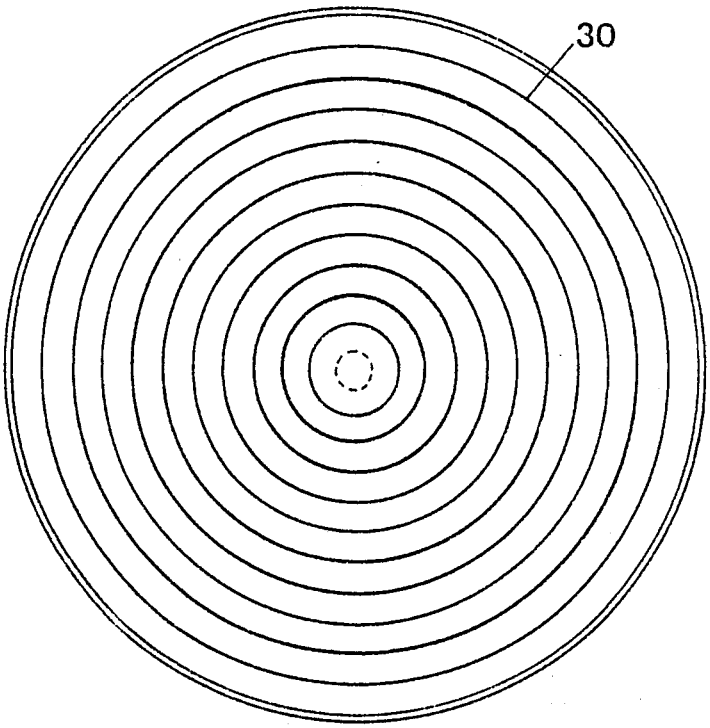
Figure 6:
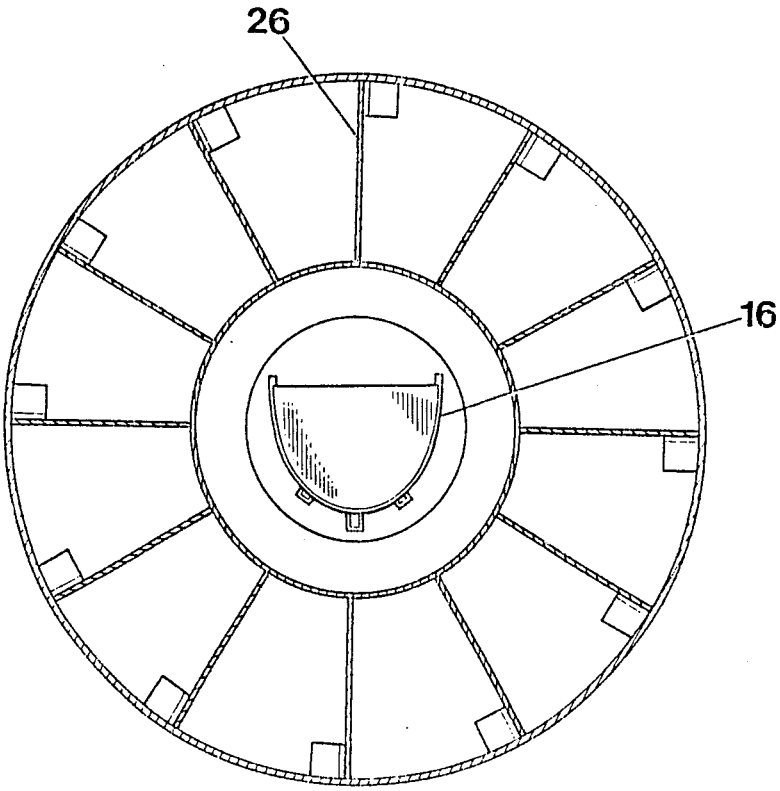

In the center or second section of the drum, lifters 22, also shown in FIG. 3, cause lifting of the soil particles to create a veil of composition passing directly through the flame and hot gases of combustion. The lifters are designed to release soil particles before a 12 o'clock position as the drum is rotated. The soil particles fall from the surface of lifters 22 up to approximately the 2 o'clock position. In the third section of the drum, near the discharge or recovery end, it is desirable to fully expose the soil to the hot gases in the drum and maximize the heat transfer to volatilize as much of the combustible contaminant material from the soil as possible. For that purpose, lifters 24 have a ledge for holding the soil until it is well past the 2 o'clock position and preferably past the 12 o'clock position. Such lifters as illustrated in FIG. 4 will thus create a substantial curtain of soil particles to be passed through the flame and hot gases as the drum is rotated. In both sections of the drum shown in FIGS. 3 and 4, brackets 25 are useful in supporting the lifters securely against the drum interior surface.

In a final section of the drum according to the preferred apparatus, slides or slide lifters 26 direct the soil into the center of the drum for recovery via chute 16 which is selectively extended into the drum for product recovery. A screen or grid assembly 30 is located in front of the slides to prevent larger particles from being recovered before they are sufficiently broken up to expose soil particles to the necessary heating and volatilization of the flammable contaminants. Such a screen will repel the large particles back into the drum where they will remain until they are broken down to suitable size for recovery. A chute 16 extends into the drum interior at the output or product recovery end of the drum. The chute may be selectively inserted into the drum to the extent necessary to recover the hot soil. Normally a few inches will be sufficient to recover composition on a continual basis with the same or approximately same amount of untreated and contaminated soil being introduced at the opposite input end of the drum through the enlarged port. The throughput rate of this soil will depend, of course, on the size of the drum, the amount of heat being directed into the drum by the burners, and the nature of the contaminating and flammable material to be removed from the soil. The lighter hydrocarbon contaminants may be removed at a lower temperature so that processing time will be faster as compared to heavier oils, and the like.

A single burner as shown in my previous patents may be used for heating the soil to the desired temperature and burning substantially all of the volatile and combustible contaminants. However, the preferred apparatus illustrated in FIG. 1 will utilize a plurality of burners. In the apparatus shown, a plurality of burners 32 extend deepest into the drum, terminating near the end of the first drum portion where lifters 20 end and lifters 22 begin. These deepest burners will direct flame and hot gases of combustion deep into the drum for burning the volatile gaseous materials as well as providing extensive heating of the cascading soil particles in the drum. A somewhat shorter burner 34 assists in heating the soil in the first drum portion. Even shorter burners 36 and 38 provide for heating the surface of the soil in the first portion of the drum as well as to create a substantial afterburning effect to remove any further combustible gases vented from the enlarged port at the forward end 12 of the drum. The heater tubes shown not only extend around the burner nozzles to protect them but also provide for induction of air into the drum to assist in combustion of the gases by providing substantial amounts of oxygen necessary for complete combustion from outside the drum. One or more blowers (not shown) may be provided for forcing air into the burner tubes.

Although the aforesaid apparatus is desirable in processing soils having a substantial amount of hydrocarbon contaminants, where contamination is not so great, a modified apparatus may be used, such as an elongated dryer drum type of apparatus such as disclosed in my U.S. Pat. No. 4,504,149, in which the composition travels through the drum in a counter-current direction from the direction in which the hot gases pass through the drum. Another example of a similar and suitable apparatus is disclosed in U.S. Pat. No. 4,136,965. The pertinent descriptions of those patents are incorporated herein by reference. In a process using an apparatus of this type, the soil will be heated gradually between the input end and the output or product recovery end, but differ from the previously described process in that the burner directs flame directly at the soil particles near the product recovery end of the drum. The soil becomes gradually heated between the cool input end of the drum as it travels in a counter-flow direction from the direction of the flame and hot gases. In this manner, any remaining contaminants in the soil at the product recovery end will become volatilized and burned there. This type of apparatus and processing is especially useful where the concentration of contaminants in the soil is less than about 1000 ppm and where smoke is not a significant problem due to relatively low concentration of volatilizable contaminant. The gases of combustion recovered at the input end of the drum may be treated to remove any particles utilizing bag-house and other state of the art gas-solid separators.

Similarly, in yet another apparatus such as a conventional dryer-drum apparatus in which material will flow parallel with the direction of flame and hot gases being introduced into the drum, the soil can be heated sufficiently to drive off substantially all of the hydrocarbon contaminants. Such apparatus are described, for example, in U.S. Pat. No. 2,421,341. However, in practicing the process in either the counter-flow or parallel flow apparatus, where light hydrocarbon contaminants such as gasoline or light fuel oils are present in the soil, they may become substantially volatilized and pass through the drum without burning. To prevent such materials from passing through the drum into the atmosphere, in addition to treating the effluent drum gases to remove particulates, they may be cooled to temperatures sufficient to condense the hydrocarbons. For example, the gases may be passed through heat exchange apparatus and the condensed hydrocarbons recovered prior to venting the cooled gases to atmosphere.

By way of example, several cubic yards of contaminated mortar sand containing between about 12,000 and about 15,000 ppm diesel fuel (62 oz./500 lbs.) were introduced into an apparatus as shown in FIG. 1. The soil was heated in the drum to a temperature of about 600° F., with volatile hydrocarbons burned in the drum prior to being vented to atmosphere. The recovered soil was found to have a hydrocarbon content of less than about 5 ppm, thereby being acceptable to environmental pollution standards.

As previously stated, the process of the invention may be used to remove substantially all of the undesirable volatile hydrocarbons from the soil. However, for most practical purposes hydrocarbon content of less than about 20 parts per million, down to even 5 parts per million, are well below most environment control standards. Thus, soils recovered from the process having residual hydrocarbon concentrations within those ranges are quite acceptable.

I claim:

1. A method of reducing the amount of hazardous flammable hydrocarbons present in a soil at a concentration of above about 100 parts per million comprising:

introducing the hydrocarbon containing soil into a rotatable drum having a first open port at a first end and a second closed port at a second end thereof, vaporizing the flammable hydrocarbons present in said soil by introducing flame and hot gases of combustion into said first port and heating said soil to a temperature of above about 300° F. while rotating said drum, successively directing said soil through first and second sections of said drum between said first and second ends, whereby in said first section adjacent said first end a curtain of particles passing through said hot gases of combustion is substantially avoided, and in said second section adjacent said second end a substantial curtain of soil particles passing through said hot gases of combustion is created as said drum is rotated, maintaining said second port closed while continuing to heat said soil until the heated soil in second section has a hydrocarbon content of less than about 5 parts per million, burning substantially all of the vaporized flammable hydrocarbons in said drum by continuing to introduce said flame and hot gases of combustion therein, and venting substantially all of the combustion gases therefrom through said first port, and recovering the heated soil from the second section of said drum through said second port.

2. The method of claim 1 including passing said soil through a third section of said drum between said first and second section wherein a curtain of soil particles is created having less particle density than in said second section.

3. The method of claim 2 wherein said hydrocarbon containing soil is heated to between about 400° and about 600° F.

4. The method of claim 1 wherein said hydrocarbon containing soil is heated to between about 400° and about 600° F.

* * * * *